US009260979B2

(12) United States Patent
Lee et al.

(10) Patent No.: US 9,260,979 B2
(45) **Date of Patent: *Feb. 16, 2016**

(54) OUTER RIM SEAL ASSEMBLY IN A TURBINE ENGINE

(71) Applicant: Siemens Aktiengesellschaft, München (DE)

(72) Inventors: Ching-Pang Lee, Cincinnati, OH (US); Kok-Mun Tham, Oviedo, FL (US); Manjit Shivanand, Winter Springs, FL (US); Vincent Paul Laurello, Hobe Sound, FL (US); Gm Salam Azad, Oviedo, FL (US); Nicholas F. Martin, York, SC (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/546,309

(22) Filed: Nov. 18, 2014

(65) Prior Publication Data

US 2015/0071763 A1 Mar. 12, 2015

Related U.S. Application Data

(63) Continuation of application No. 13/768,561, filed on Feb. 15, 2013, now Pat. No. 8,939,711.

(51) Int. Cl.
*F01D 25/12* (2006.01)
*F01D 11/00* (2006.01)
(Continued)

(52) U.S. Cl.
CPC ..... *F01D 25/12* (2013.01); *F01D 5/081* (2013.01); *F01D 11/001* (2013.01); *F01D 11/04* (2013.01); *F01D 11/122* (2013.01); *F05D 2260/202* (2013.01)

(58) Field of Classification Search
CPC ..... F01D 11/001; F01D 11/00; F01D 11/02; F01D 11/04; F01D 11/127; F01D 5/081; F01D 5/082; F01D 25/12; F01D 11/122; F05D 2240/81; F05D 2240/82; F05D 2260/202; F02C 7/28
See application file for complete search history.

(56) References Cited

U.S. PATENT DOCUMENTS 3,936,215 A * 2/1976 Hoff ..... 415/115
5,222,742 A 6/1993 Roberts
(Continued)

FOREIGN PATENT DOCUMENTS

EP 2586996 A2 5/2013

OTHER PUBLICATIONS

Role, Florian; International Search Report and Written Opinion of ISA Application No. PCT/EP2014/051704; May 9, 2014; European Patent Office; Rijswijk, Netherlands.

*Primary Examiner* — Edward Look
*Assistant Examiner* — Danielle M Christensen

(57) ABSTRACT

A seal assembly between a hot gas path and a disc cavity in a turbine engine includes a non-rotatable vane assembly including a row of vanes and an inner shroud, a rotatable blade assembly axially adjacent to the vane assembly and including a row of blades and a turbine disc that forms a part of a turbine rotor, and an annular wing member located radially between the hot gas path and the disc cavity. The wing member extends generally axially from the blade assembly toward the vane assembly and includes a plurality of circumferentially spaced apart flow passages extending therethrough from a radially inner surface thereof to a radially outer surface thereof. The flow passages each include a portion that is curved as the passage extends radially outwardly to effect a scooping of cooling fluid from the disc cavity into the flow passages and toward the hot gas path.

18 Claims, 4 Drawing Sheets

(51) Int. Cl.

| | |
|---|---|
| ***F01D 11/04*** | (2006.01) |
| ***F01D 5/08*** | (2006.01) |
| ***F01D 11/12*** | (2006.01) |

(56) References Cited

U.S. PATENT DOCUMENTS

| | | | |
|---|---|---|---|
| 5,224,713 | A | 7/1993 | Pope |
| 5,358,374 | A | 10/1994 | Correia et al. |
| 5,967,745 | A | 10/1999 | Tomita et al. |
| 6,017,189 | A | 1/2000 | Judet et al. |
| 6,077,035 | A | 6/2000 | Walters et al. |
| 6,506,016 | B1 | 1/2003 | Wang |
| 7,044,710 | B2 | 5/2006 | Naik et al. |
| 7,189,055 | B2 | 3/2007 | Marini et al. |
| 7,238,008 | B2 | 7/2007 | Bobo et al. |
| 7,244,104 | B2 | 7/2007 | Girgis et al. |
| 7,465,152 | B2 | 12/2008 | Nigmatulin |
| 7,500,824 | B2 | 3/2009 | Cheng et al. |
| 7,637,716 | B2 | 12/2009 | Benton |
| 7,874,799 | B2 | 1/2011 | Young et al. |
| 2009/0129916 | A1 | 5/2009 | Young et al. |
| 2011/0193293 | A1 | 8/2011 | Mega et al. |
| 2013/0108441 | A1 | 5/2013 | Ingram |
| 2013/0170983 | A1 | 7/2013 | Babu et al. |

* cited by examiner

OUTER RIM SEAL ASSEMBLY IN A TURBINE ENGINE

CROSS REFERENCE TO RELATED APPLICATIONS

This application is a continuation of U.S. patent application Ser. No. 13/768,561 filed Feb. 15, 2013, now allowed, entitled "OUTER RIM SEAL ASSEMBLY IN A TURBINE ENGINE", the entire disclosure of which is hereby incorporated by reference herein.

FIELD OF THE INVENTION

The present invention relates generally to an outer rim seal assembly for use in a turbine engine, and, more, particularly, to an outer rim seal assembly comprising an annular wing member that includes a plurality of flow passages extending radially therethrough for pumping cooling fluid out of a disc cavity toward a hot gas path.

BACKGROUND OF THE INVENTION

In multistage rotary machines such as gas turbine engines, a fluid, e.g., intake air, is compressed in a compressor section and mixed with a fuel in a combustion section. The mixture of air and fuel is ignited in the combustion section to create combustion gases that define a hot working gas that is directed to one or more turbine stages within a turbine section of the engine to produce rotational motion of turbine components. Both the turbine section and the compressor section have stationary or non-rotating components, such as vanes, for example, that cooperate with rotatable components, such as blades, for example, for compressing and expanding the hot working gas. Many components within the machines must be cooled by a cooling fluid to prevent the components from overheating.

Ingestion of hot working gas from a hot gas path into disc cavities in the machines that contain cooling fluid reduces engine performance and efficiency, e.g., by yielding higher disc and blade root temperatures. Ingestion of the working gas from the hot gas path into the disc cavities may also reduce service life and/or cause failure of the components in and around the disc cavities.

SUMMARY OF THE INVENTION

In accordance with a first aspect of the invention, a seal assembly is provided between a hot gas path and a disc cavity in a turbine engine. The seal assembly comprises a non-rotatable vane assembly including a row of vanes and an inner shroud, and a rotatable blade assembly axially adjacent to the vane assembly. The blade assembly includes a row of blades and a turbine disc that forms a part of a turbine rotor, the blades extending from a platform of the blade assembly. The seal assembly further includes an annular wing member located radially between the hot gas path and the disc cavity. The wing member extends generally axially from the blade assembly toward the vane assembly and includes a plurality of circumferentially spaced apart flow passages extending therethrough from a radially inner surface thereof to a radially outer surface thereof. The flow passages each include a portion that is curved as the passage extends radially outwardly to effect a scooping of cooling fluid from the disc cavity into the flow passages and toward the hot gas path during operation of the engine.

In accordance with a second aspect of the invention, a seal assembly is provided between a hot gas path and a disc cavity in a turbine engine. The seal assembly comprises a non-rotatable vane assembly including a row of vanes and an inner shroud, and a rotatable blade assembly axially adjacent to the vane assembly. The blade assembly includes a row of blades and a turbine disc that forms a part of a turbine rotor, the blades extending from a platform of the blade assembly. The seal assembly further includes an annular seal member and an annular wing member. The seal member extends axially from the vane assembly toward the blade assembly and includes a seal surface. The wing member is located radially inwardly from the hot gas path and the seal member and radially outwardly from the disc cavity. The wing member extends generally axially from an axially facing side of the blade assembly toward the vane assembly, and includes a portion in close proximity to the seal surface of the seal member. A plurality of circumferentially spaced apart flow passages extend through the wing member from a radially inner surface thereof to a radially outer surface thereof. Outlets of the flow passages are located axially between a downstream axial end of the seal member and an upstream end of the platform. The flow passages each include a portion that is curved in the circumferential direction as it extends radially outwardly through the wing member to effect a scooping of cooling fluid from the disc cavity into the flow passages and toward the hot gas path during operation of the engine.

In accordance with a third aspect of the invention, a seal assembly is provided between a hot gas path and a disc cavity in a turbine engine. The seal assembly comprises a non-rotatable vane assembly including a row of vanes and an inner shroud, and a rotatable blade assembly axially adjacent to the vane assembly. The blade assembly includes a row of blades and a turbine disc that forms a part of a turbine rotor, the blades extending from a platform of the blade assembly. The seal assembly further includes an annular wing member located radially between the hot gas path and the disc cavity and extending generally axially from the blade assembly toward the vane assembly. The wing member includes a plurality of circumferentially spaced apart flow passages extending therethrough from a radially inner surface thereof to a radially outer surface thereof. Outlets of the flow passages are located axially between a downstream end of the inner shroud and an upstream end of the platform. The flow passages each include a portion that is curved against the direction of rotation of the turbine rotor as the passage extends radially outwardly to effect a scooping of cooling fluid from the disc cavity into the flow passages and toward the hot gas path during operation of the engine.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
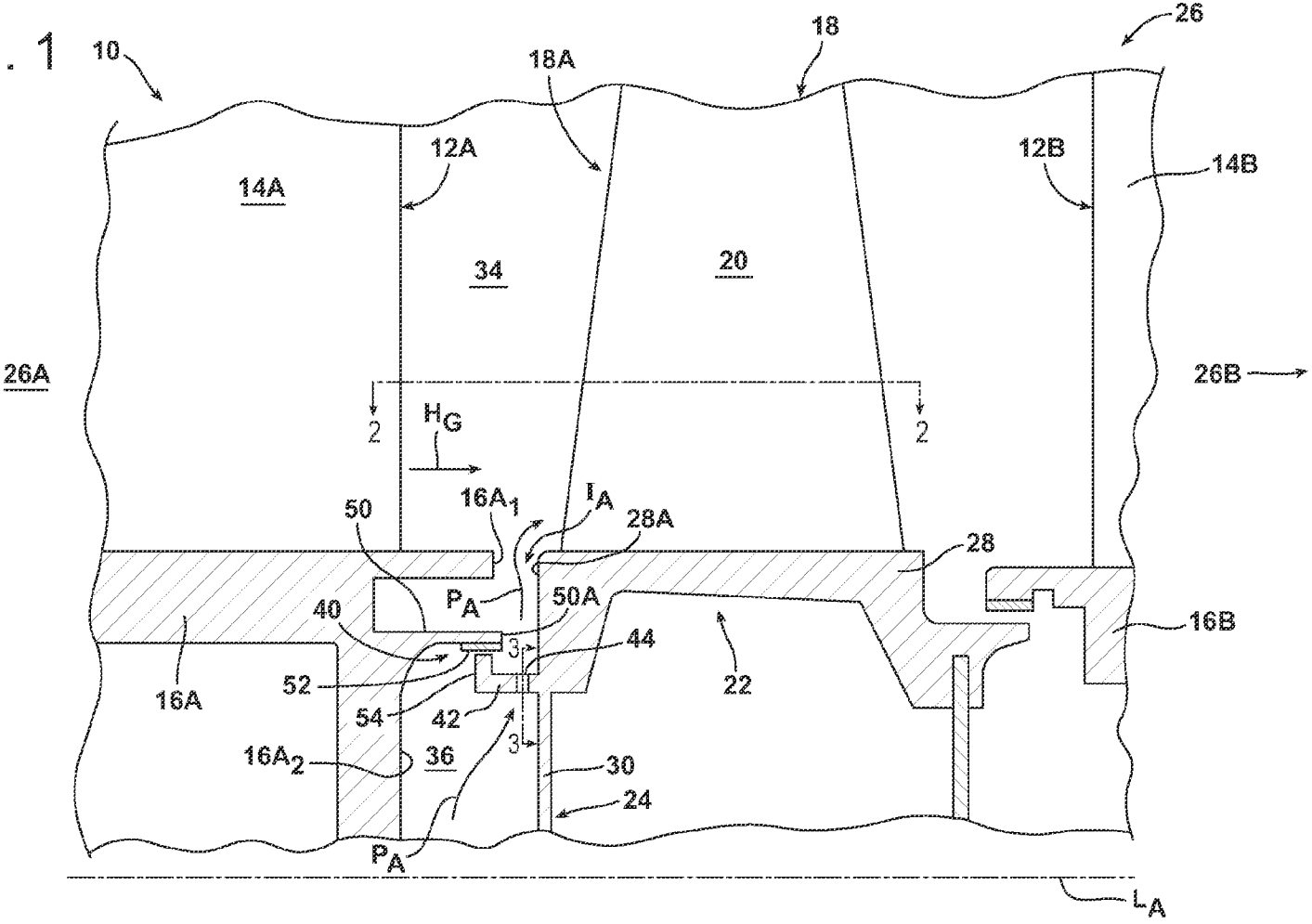
FIG. 1 is a diagrammatic sectional view of a portion of a turbine engine including an outer rim seal assembly in accordance with an embodiment of the invention.

Referring to FIG. 1, a portion of a turbine engine 10 is illustrated diagrammatically including upstream and downstream stationary vane assemblies 12A, 12B including respective rows of vanes 14A, 14B suspended from an outer casing (not shown) and affixed to respective annular inner shrouds 16A, 166, and a blade assembly 18 including a plurality of blades 20 and rotor disc structure 22 that forms a part of a turbine rotor 24. The upstream vane assembly 12A and the blade assembly 18 may be collectively referred to herein as a "stage" of a turbine section 26 of the engine 10, which may include a plurality of stages as will be apparent to those having ordinary skill in the art. The vane assemblies and blade assemblies within the turbine section 26 are spaced apart from one another in an axial direction defining a longitudinal axis $L_A$ of the engine 10, wherein the vane assembly 12A illustrated in FIG. 1 is upstream from the illustrated blade assembly 18 and the vane assembly 126 illustrated in FIG. 1 is downstream from the illustrated blade assembly 18 with respect to an inlet 26A and an outlet 26B of the turbine section 26, see FIG. 1.

The rotor disc structure 22 may comprise a platform 28, a turbine disc 30, and any other structure associated with the blade assembly 18 that rotates with the rotor 24 during operation of the engine 10, such as, for example, roots, side plates, shanks, etc.

The vanes 14A, 14B and the blades 20 extend into an annular hot gas path 34 defined within the turbine section 26. A hot working gas $H_G$ comprising hot combustion gases is directed through the hot gas path 34 and flows past the vanes 14A, 14B and the blades 20 to remaining stages during operation of the engine 10. Passage of the working gas $H_G$ through the hot gas path 34 causes rotation of the blades 20 and the corresponding blade assembly 18 to provide rotation of the turbine rotor 24.

Referring still to FIG. 1, a disc cavity 36 is located radially inwardly from the hot gas path 34. The disc cavity 36 is located axially between the annular inner shroud 16A of the upstream vane assembly 12A and the rotor disc structure 22. Cooling fluid, such as purge air $P_A$ comprising compressor discharge air, is provided into the disc cavity 36 to cool the inner shroud 16A and the rotor disc structure 22. The purge air $P_A$ also provides a pressure balance against the pressure of the working gas $H_G$ flowing through the hot gas path 34 to counteract ingestion of the working gas $H_G$ into the disc cavity 36. The purge air $P_A$ may be provided to the disc cavity 36 from cooling passages (not shown) formed through the rotor 24 and/or from other upstream passages (not shown) as desired. It is noted that additional disc cavities (not shown) are typically provided between remaining inner shrouds and corresponding adjacent rotor disc structures. It is further noted that other types of cooling fluid than compressor discharge air could be provided into the disc cavity 36, such as, for example, cooling fluid from an external source or air extracted from a portion of the engine 10 other than the compressor.

Components of the upstream vane assembly 12A and the blade assembly 18 radially inwardly from the respective vanes 14A and blades 20 cooperate to form an annular seal assembly 40 between the hot gas path 34 and the disc cavity 36. The annular seal assembly 40 assists in preventing ingestion of the working gas $H_G$ from the hot gas path 34 into the disc cavity 36 and delivers a portion of the purge air $P_A$ out of the disc cavity 36 as will be described herein. It is noted that additional seal assemblies 40 similar to the one described herein may be provided between the inner shrouds and the adjacent rotor disc structures of the remaining stages in the engine 10, i.e., for assisting in preventing ingestion of the working gas $H_G$ from the hot gas path 34 into the respective disc cavities and to deliver purge air $P_A$ out of the disc cavities 36.

Figure 2:
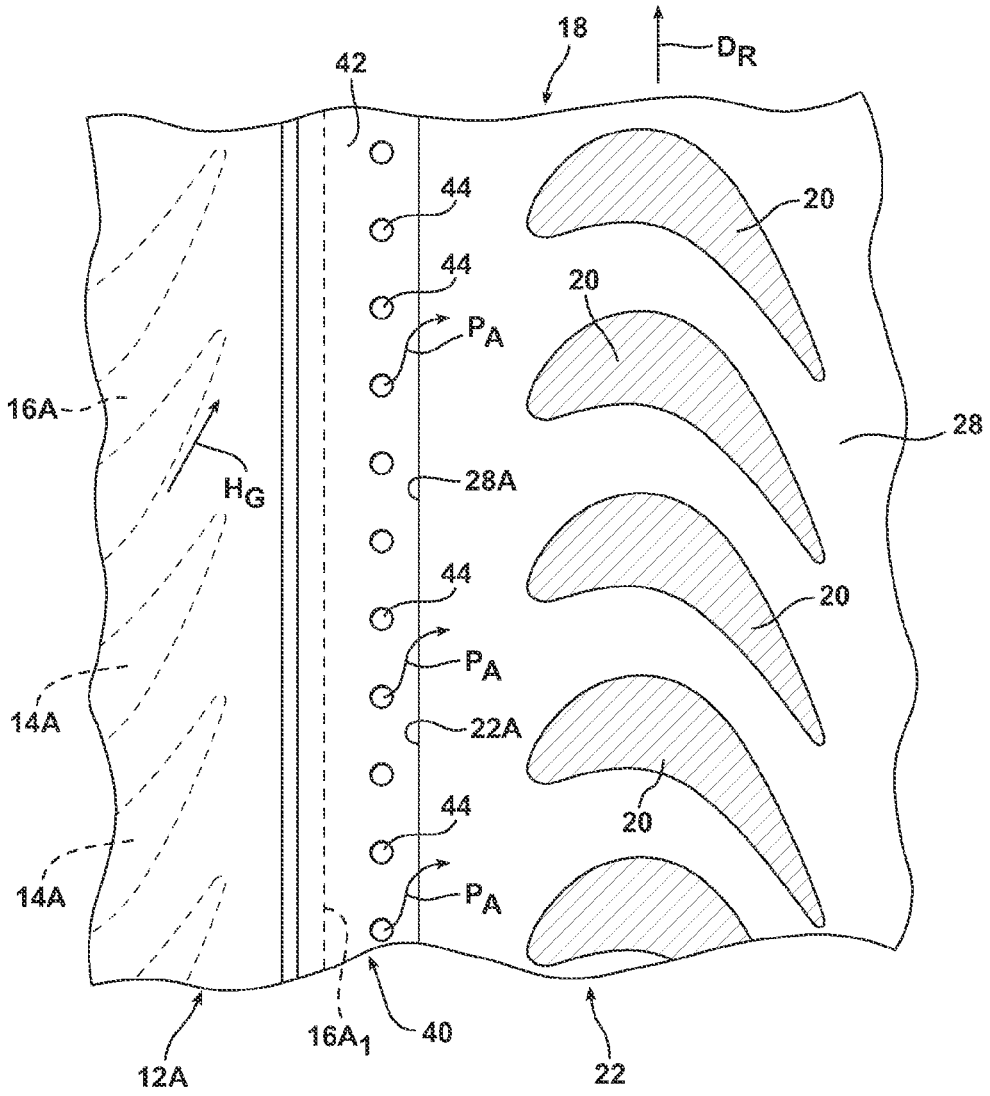
FIG. 2 is a cross sectional view taken along line 2-2 from FIG. 1.
Figure 3:
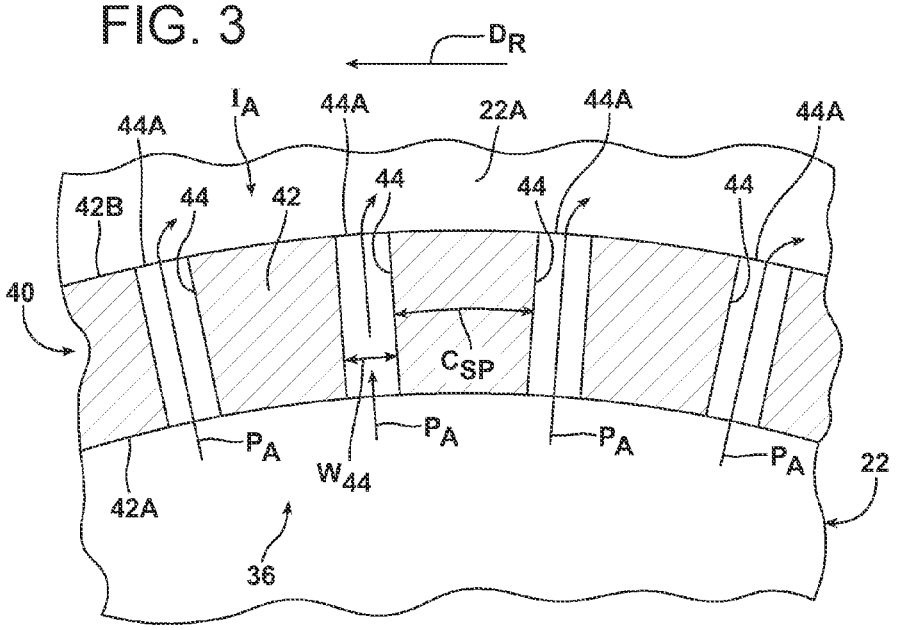
FIG. 3 is a cross sectional view taken along line 3-3 from FIG. 1 and illustrating a plurality of flow passages formed in a wing member of the outer rim seal assembly shown in FIG. 1.

As shown in FIGS. 1-3, the seal assembly 40 comprises an annular wing member 42 located radially between the hot gas path 34 and the disc cavity 36 and extending generally axially from an axially facing side 22A of the rotor disc structure 22 toward the upstream vane assembly 12A (it is noted that the upstream vane assembly 12A is illustrated in phantom lines in FIG. 2 for clarity). The wing member 42 may be formed as an integral part of the rotor disc structure 22 as shown in FIG. 1, or may be formed separately from the rotor disc structure 22 and affixed thereto. The illustrated wing member 42 is generally arcuate shaped in a circumferential direction when viewed axially, see FIG. 3. As shown in FIG. 1, the wing member 42 preferably overlaps a downstream end 16$A_1$ of the inner shroud 16A of the upstream vane assembly 12A.

Referring still to FIGS. 1-3, the wing member 42 includes a plurality of circumferentially spaced apart flow passages 44. The flow passages 44 extend through the wing member 42 from a radially inner surface 42A thereof to a radially outer surface 42B thereof, see FIG. 3. As shown, in FIG. 2, the flow passages 44 are preferably aligned in an annular row, wherein widths $W_{44}$ of the flow passages 44 (see FIG. 3) and circumferential spaces $C_{SP}$ (see FIG. 3) between adjacent flow passages 44 may vary depending on the particular configuration of the engine 10 and depending on a desired configuration for ejecting purge air $P_A$ through the flow passages 44, as will be described in more detail below. While the flow passages 44 in the embodiment shown in FIGS. 1-3 extend generally radially straight through the wing member 42, the flow passages 44 could have other configurations, such as those shown in FIGS. 4-6, which will be described below.

As shown in FIG. 1, the seal assembly 40 further comprises an annular seal member 50 that extends from a generally axially facing surface 16$A_2$ of the inner shroud 16A of the upstream vane assembly 12A. The seal member 50 extends axially toward the rotor disc structure 22 of the blade assembly 18 and is located radially outwardly from the wing member 42 and overlaps the wing member 42 such that any ingestion of hot working gas $H_G$ from the hot gas path 34 into the disc cavity 36 must travel through a tortuous path. A downstream axial end 50A of the seal member 50 includes a seal surface 52 that is in close proximity to an annular radially outwardly extending flange 54 of the wing member 42. The seal member 50 may be formed as an integral part of the inner shroud 16A, or may be formed separately from the inner shroud 16A and affixed thereto. The seal surface 52 may comprise an abradable material that is sacrificed in the case of contact between the flange 54 and the seal surface 52. As clearly shown in FIG. 1, the flow passages 44 are entirely located axially between the downstream end 16$A_1$ of the inner shroud 16A and an upstream end 28A of the platform 28, such that outlets 44A of the flow passages 44 (see FIG. 3) are also located between the downstream end 16$A_1$ of the inner shroud 16A and the upstream end 28A of the platform 28. The flow passages 44 are also entirely shown in FIG. 1 as being located axially between the downstream axial end 50A of the seal member 50 and the upstream end 28A of the platform 28, such that the outlets 44A of the flow passages 44 are also located between the downstream axial end 50A of the seal member 50 and the upstream end 28A of the platform 28.

During operation of the engine 10, passage of the hot working gas $H_G$ through the hot gas path 34 causes the blade assembly 18 and the turbine rotor 24 to rotate in a direction of rotation $D_R$ shown in FIGS. 2 and 3.

Rotation of the blade assembly 18 and a pressure differential between the disc cavity 36 and the hot gas path 34, i.e., the pressure in the disc cavity 36 is greater than the pressure in the hot gas path 34, effect a pumping of purge air $P_A$ from the disc cavity 36 through the flow passages 44 toward the hot gas path 34 to assist in limiting hot working, gas $H_G$ ingestion from the hot gas path 34 into the disc cavity 36 by forcing the hot working gas $H_G$ away from the seal assembly 40. Since the seal assembly 40 limits hot working gas $H_G$ ingestion from the hot gas path 34 into the disc cavity 36, the seal assembly 40 correspondingly allows for a smaller amount of purge air $P_A$ to be provided to the disc cavity 36, thus increasing engine efficiency. It is noted that additional purge air $P_A$ may pass from the disc cavity 36 into the hot gas path 34 between the seal surface 52 of the seal member 50 and the flange 54 of the wing member 42.

In accordance with an aspect of the present invention, the outlets 44A of the flow passages 44 (see FIG. 3) are positioned near known areas of ingestion $I_A$ (see FIGS. 1 and 3) of hot working gas $H_G$ from the hot gas path 34 into the disc cavity 36, such that the purge air $P_A$ exiting the flow passages 44 through the outlets 44A forces the working gas $H_G$ away from the known areas of ingestion $I_A$. For example, known areas of ingestion $I_A$ have been determined to be located between the upstream vane assembly 12A and the blade assembly 18 at an upstream side 18A of the blade assembly 18 with reference to the general flow direction of the hot working gas $H_G$ through the hot gas path 34, see FIG. 1. As shown in FIG. 1, due to the positioning of the outlets 44A between the downstream end 16$A_1$ of the inner shroud 16A and the upstream end 28A of the platform 28, and between the downstream axial end 50A of the seal member 50 and the upstream end 28A of the platform 28, the purge air $P_A$ exiting the flow passages 44 through the outlets 44A has an unobstructed path from the outlets 44A to the hot gas path 34.

Contrary to traditional practice of using seals between disc cavities 36 and hot gas paths 34 that attempt to eliminate or minimize all leakage paths between the disc cavities 36 and the hot gas path 34, it has been found that providing the flow passages 44 of the present invention in the wing member 42 at the known areas of ingestion $I_A$ have favorable sealing results with less ingestion of hot working gas $H_G$ from the hot gas path 34 into the disc cavity 36 compared to seal assemblies that do not include such flow passages 44. Such favorable results are believed to be attributed to a more precise and controlled discharge of the purge air $P_A$ that is pumped out of the disc cavities 36 toward the known areas of ingestion $I_A$.

Figure 4:
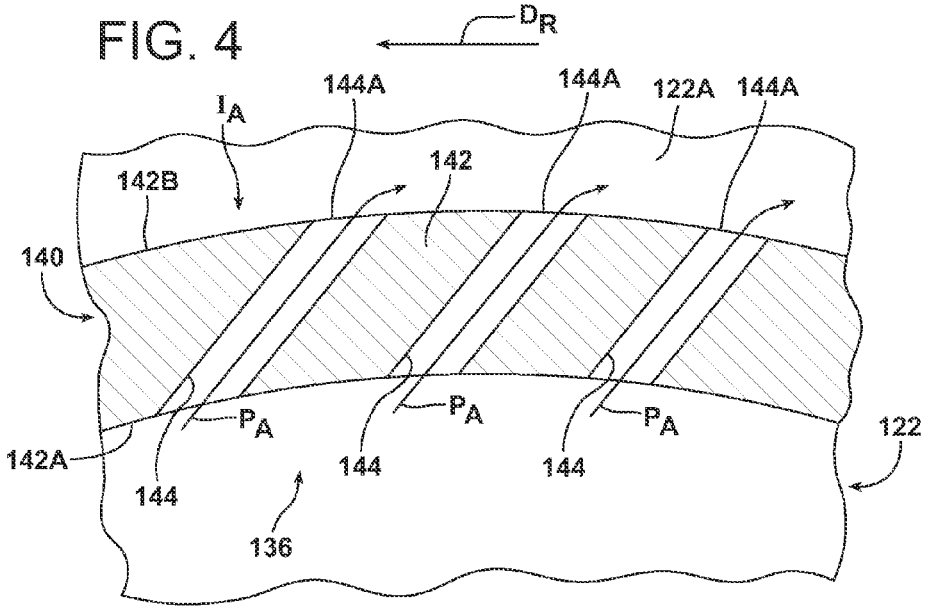
FIGS. 4-6 are views similar to the view of FIG. 3 of a plurality of flow passages of outer rim seal assemblies according to other embodiments of the invention.
Figure 5:
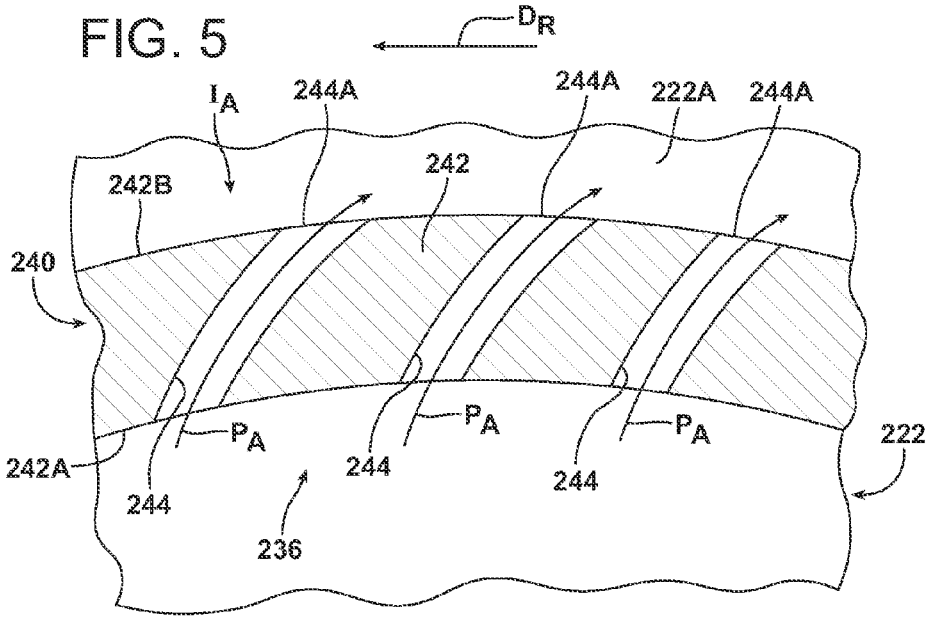
Figure 6:
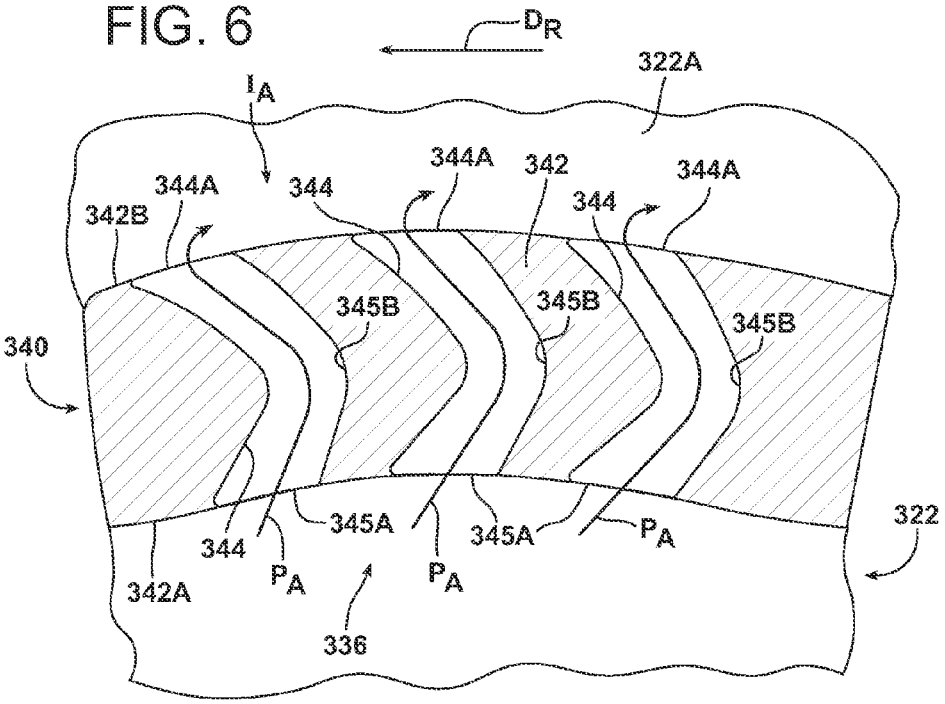

Referring now to FIGS. 4-6, respective seal assemblies 140, 240, 340 according to other embodiments are shown, where structure similar to that described above with reference to FIGS. 1-3 includes the same reference number increased by 100 in FIG. 4, by 200 in FIG. 5, and by 300 in FIG. 6.

In FIGS. 4 and 5, the respective flow passages 144, 244 according to these embodiments are angled (FIG. 4) and curved (FIG. 5) in a direction against a direction of rotation $D_R$ of the turbine rotor (not shown in this embodiment). Angling/curving of the flow passages 144, 244 in this manner effects a scooping of purge air $P_A$ from the disc cavities 136, 236 into the flow passages 144, 244 so as to increase the amount of purge air $P_A$ that passes into the flow passages 144, 244 and that is discharged toward the hot gas paths (not shown in these embodiments). Hence, it is believed that an even smaller amount of purge air $P_A$ may be able to be provided into the disc cavities 136, 236 according to these embodiments.

In FIG. 6, the flow passages 344 according to this embodiment include entrance portions 345A that are angled in a direction against a direction of rotation $D_R$ of the turbine rotor (not shown in this embodiment) such that purge air $P_A$ is scooped from the disc cavity 336 into the flow passages 344 as described above with reference to FIGS. 4 and 5. However, in this embodiment middle portions 345B of the flow passages 344 include a curve, i.e., a direction shift, such that outlets 344A of the flow passages 344 are angled with the direction of rotation $D_R$ of the turbine rotor. Such a configuration allows the purge air $P_A$ to be discharged from the flow passages 344 according to this embodiment in a flow direction including a component that is in the same direction as the direction of rotation $D_R$ of the turbine rotor.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A seal assembly between a hot gas path and a disc cavity in a turbine engine comprising:

a non-rotatable vane assembly including a row of vanes and an inner shroud;

a rotatable blade assembly axially adjacent to the vane assembly and including a row of blades and a turbine disc that forms a part of a turbine rotor, the blades extending from a platform of the blade assembly; and an annular wing member located radially between the hot gas path and the disc cavity and extending generally axially from the blade assembly toward the vane assembly, the wing member including a plurality of circumferentially spaced apart flow passages extending therethrough from a radially inner surface thereof to a radially outer surface thereof, wherein the flow passages each include a portion that is curved against the direction of rotation of the turbine rotor as the passage extends radially outwardly to effect a scooping of cooling fluid from the disc cavity into the flow passages and toward the hot gas path during operation of the engine.

2. The seal assembly according to claim 1, wherein outlets of the flow passages are located axially between a downstream end of the inner shroud and an upstream end of the platform.

3. The seal assembly according to claim 2, wherein the flow passages are entirely located axially between the downstream end of the inner shroud and the upstream end of the platform.

4. The seal assembly according to claim 1, further comprising an annular seal member that extends axially from the vane assembly toward the blade assembly, the seal member including a seal surface that is in close proximity to a portion of the wing member.

5. The seal assembly according to claim 4, wherein the seal member is located radially outwardly from the wing member and overlaps the wing member in the axial direction, and wherein the outlets of the flow passages are located axially between a downstream axial end of the seal member and the upstream end of the platform.

6. The seal assembly according to claim 5, wherein the wing member includes an annular radially outwardly extending flange that is in close proximity to the seal surface of the seal member.

7. The seal assembly according to claim 6, wherein the seal surface of the seal member comprises an abradable material that is sacrificed in the case of contact between the flange and the seal surface.

8. The seal assembly according to claim 1, wherein:

outlets of the flow passages are positioned near known areas of ingestion of hot gas from the hot gas path into the disc cavity such that the cooling fluid exiting the flow passages through the outlets forces the hot gas away from the known areas of ingestion; and the known areas of ingestion are located between the vane assembly and the blade assembly at an upstream side of the blade assembly with reference to a flow direction of the hot gas through the hot gas path.

9. The seal assembly according to claim 1, wherein the scooping of cooling fluid from the disc cavity toward the hot gas path is effected by rotation of the turbine rotor and the blade assembly to limit hot gas ingestion from the hot gas path to the disc cavity by forcing hot gas in the hot gas path away from the seal assembly.

10. A seal assembly between a hot gas path and a disc cavity in a turbine engine comprising:

a non-rotatable vane assembly including a row of vanes and an inner shroud;

a rotatable blade assembly axially adjacent to the vane assembly and including a row of blades and a turbine disc that forms a part of a turbine rotor, the blades extending from a platform of the blade assembly;

an annular seal member that extends axially from the vane assembly toward the blade assembly and includes a seal surface; and an annular wing member located radially inwardly from the hot gas path and the seal member and radially outwardly from the disc cavity, the wing member extending generally axially from an axially facing side of the blade assembly toward the vane assembly and including:

a portion in close proximity to the seal surface of the seal member; and a plurality of circumferentially spaced apart flow passages extending therethrough from a radially inner surface thereof to a radially outer surface thereof, wherein outlets of the flow passages are located axially between a downstream axial end of the seal member and an upstream end of the platform, and wherein the flow passages each include a portion that is curved in the circumferential direction against the direction of rotation of the turbine rotor as it extends radially outwardly through the wing member to effect a scooping of cooling fluid from the disc cavity into the flow passages and toward the hot gas path during operation of the engine.

11. The seal assembly according to claim 10, wherein the seal member axially overlaps the wing member.

12. The seal assembly according to claim 11, wherein the wing member includes an annular radially outwardly extending flange that comprises the portion of the wing member in close proximity to the seal surface of the seal member, and wherein the seal surface of the seal member comprises an abradable material that is sacrificed in the case of contact between the flange and the seal surface.

13. The seal assembly according to claim 10, wherein:

the outlets of the flow passages are positioned near known areas of ingestion of the hot gas from the hot gas path into the disc cavity such that the cooling fluid exiting the flow passages through the outlets forces the hot gas away from the known areas of ingestion; and the known areas of ingestion are located between the vane assembly and the blade assembly at an upstream side of the blade assembly with reference to a flow direction of the hot gas through the hot gas path.

14. The seal assembly according to claim 10, wherein the flow passages are entirely located axially between the upstream end of the platform and each of a downstream end of the inner shroud and the downstream axial end of the seal member.

15. A seal assembly between a hot gas path and a disc cavity in a turbine engine comprising:

a non-rotatable vane assembly including a row of vanes and an inner shroud;

a rotatable blade assembly axially adjacent to the vane assembly and including a row of blades and a turbine disc that forms a part of a turbine rotor, the blades extending from a platform of the blade assembly; and an annular wing member located radially between the hot gas path and the disc cavity and extending generally axially from the blade assembly toward the vane assembly, the wing member including a plurality of circumferentially spaced apart flow passages extending therethrough from a radially inner surface thereof to a radially outer surface thereof, wherein outlets of the flow passages are located axially between a downstream end of the inner shroud and an upstream end of the platform, and wherein the flow passages each include a portion that is curved against the direction of rotation of the turbine rotor as the passage extends radially outwardly to effect a scooping of cooling fluid from the disc cavity into the flow passages and toward the hot gas path during operation of the engine.

16. The seal assembly according to claim 15, further comprising an annular seal member that extends axially from the vane assembly toward the blade assembly, the seal member including a seal surface that is in close proximity to a portion of the wing member, wherein the seal member is located radially outwardly from the wing member and overlaps the wing member in the axial direction, and wherein the outlets of the flow passages are located axially between a downstream axial end of the seal member and the upstream end of the platform.

17. The seal assembly according to claim 16, wherein the wing member includes an annular radially outwardly extending flange that is in close proximity to the seal surface of the seal member, and wherein the seal surface of the seal member comprises an abradable material that is sacrificed in the case of contact between the flange and the seal surface.

18. The seal assembly according to claim 15, wherein:

the outlets of the flow passages are positioned near known areas of ingestion of hot gas from the hot gas path into the disc cavity such that the cooling fluid exiting the flow passages through the outlets forces the hot gas away from the known areas of ingestion;

the known areas of ingestion are located between the vane assembly and the blade assembly at an upstream side of the blade assembly with reference to a flow direction of the hot gas through the hot gas path; and the scooping of cooling fluid from the disc cavity toward the hot gas path is effected by rotation of the turbine rotor and the blade assembly to limit hot gas ingestion from the hot gas path to the disc cavity by forcing hot gas in the hot gas path away from the seal assembly.

* * * * *